US007384672B2

(12) United States Patent
Chang et al.

(10) Patent No.: US 7,384,672 B2
(45) **Date of Patent: *Jun. 10, 2008**

(54) HEAT TRANSFER RECORDING SHEETS

(75) Inventors: Chialu Chang, Ann Arbor, MI (US); Yaoliang Hong, Oakland, NJ (US); Thomas Z Fu, Milford, OH (US)

(73) Assignee: International Paper Company, Memphis, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/384,907

(22) Filed: Mar. 20, 2006

(65) Prior Publication Data

US 2006/0159873 A1 Jul. 20, 2006

Related U.S. Application Data

(63) Continuation of application No. 10/613,587, filed on Jul. 2, 2003, now Pat. No. 7,026,024.

(51) Int. Cl.
*B41M 5/50* (2006.01)

(52) U.S. Cl. ..... 428/32.51; 156/235; 428/32.51

(58) Field of Classification Search ..... None
See application file for complete search history.

(56) References Cited

U.S. PATENT DOCUMENTS 4,863,781 A 9/1989 Kronzer
5,242,739 A 9/1993 Kronzer et al.
5,271,990 A 12/1993 Kronzer et al.
5,501,902 A 3/1996 Kronzer
5,798,179 A 8/1998 Kronzer
6,042,914 A * 3/2000 Lubar ..... 428/32.12
6,177,187 B1 * 1/2001 Niemoller et al. ..... 428/32.12
6,582,803 B2 6/2003 Cole et al.
6,689,421 B2 * 2/2004 Patel et al. ..... 427/245
7,026,024 B2 * 4/2006 Chang et al. ..... 428/32.77
2002/0009576 A1 1/2002 Fu et al.

* cited by examiner

*Primary Examiner*—Bruce H Hess
(74) *Attorney, Agent, or Firm*—Thomas W. Barnes, III

(57) ABSTRACT

A heat transfer recording sheet comprising a support layer; an adhesive layer; and at least one ink receiving layer comprising a microporous polymeric film including at least one thermoplastic polymer. The thermoplastic polymer may be blended with a hydrophilic melt additive prior to extrusion and stretching or an already extruded and stretched microporous polymeric film may be coated with an additional layer of inorganic pigment and binder. The recording sheet containing a printed image is transferred onto target substrates such as paper and textiles.

21 Claims, 2 Drawing Sheets

HEAT TRANSFER RECORDING SHEETS

This application is a Continuation Application of U.S. patent application Ser. No. 10/613,587, now U.S. Pat. No. 7,026,024, entitled "HEAT TRANSFER RECORDING SHEETS ", which was filed on Jul. 2, 2003, which is hereby incorporated, in its entirety, herein by reference.

FIELD OF INVENTION

The present invention is directed to heat transfer recording sheets. The recording sheet containing a printed image is transferred onto a target substrate such as paper and textiles. The recording sheet comprises an ink receiving layer that is made of a microporous polymeric film of a thermoplastic polymer.

BACKGROUND OF THE INVENTION

In general, image transfer materials are known in the art. For example, U.S. Pat. No. 5,501,902 to Kronzer describes an ink jet printable heat transfer material comprised of a first layer of film, paper, web or foil, and a second, ink receptive layer, having a melting point of 65° C. to 180° C. composed of particles of thermoplastic polymer having a certain dimension, a film forming binder based on the weight of the thermoplastic polymer, and a cationic polymer.

Similarly, U.S. Pat. No. 5,798,179 to Kronzer is directed to a heat transfer material having cold release properties for use in ink jet printing made of three layers. The first layer is a film or cellulosic nonwoven web. The second layer is composed of a thermoplastic polymer having essentially no tack at the transfer temperature, such as hard acrylic polymer or poly(vinyl acetate), and having various other characteristics. The third layer includes a thermoplastic polymer which melts between 65° C. and 180° C.

The present invention is an improvement over these patents and other heat transfer recording materials and sheets, in general. Ink jet printers utilize inks that are mostly water-based. When printing images on heat transfer recording sheets, it is important to eliminate the ink solvent, which is comprised primarily of water, because the printed image must be dry before it can be effectively transferred. This is either accomplished by waiting a long period of time for the water to evaporate, or, to remove the water in another manner.

In the recording sheets of the present invention, which comprise an ink receiving layer made of microporous polymeric film, the microporous polymeric film functions as a reservoir and an evaporator for the water. After the image is printed, the micropores of the film absorb the ink solvent by capillary action, removing it from the surface of the layer. The ink solvent is thereafter quickly evaporated into the air through the micropores. This allows for the recording sheet to dry very quickly, which, in turn, results in virtually no waiting time for ink drying after printing and less image smearing problems.

Accordingly, it is the broad object of the present invention to provide an improved heat transfer recording sheet, which can be printed with personalized designs that are transferred onto target substrates such as paper, textiles, metal and ceramics.

It is another object of the present invention to provide a method to transfer a printed image to a target substrate.

SUMMARY OF THE INVENTION

The present invention is directed to a heat transfer recording sheet comprised of a support layer; an adhesive layer; and at least one ink receiving layer comprised of a microporous polymeric film including at least one thermoplastic polymer. The microporous polymeric film is hydrophilic. The thermoplastic polymer is extruded and mechanically stretched to form the microporous polymeric film, preferably the thermoplastic polymer is biaxially stretched. The microporous polymeric film which makes up the ink receiving layer is ink jet printable.

In one embodiment, a release layer is coated between the support layer and adhesive layer. The release layer is comprised of wax or silicon.

The thermoplastic polymer is selected from the group consisting of polyolefin, polyester, polyamide, and polyurethane. Alternatively, the thermoplastic polymer is a polyolefin and a polar functional monomer copolymer.

In one embodiment of the heat transfer recording sheets of the present invention; the thermoplastic polymer is combined with a hydrophilic polymer melt additive to form a blend. The polymeric melt additive is comprised of a surfactant. Preferably, the amount of thermoplastic polymer in the blend is between 80% and 99.9% by dry weight, and, accordingly, the amount of polymeric melt additive in the blend is between 0.1% and 20% by dry weight. The blend is extruded and mechanically stretched to create the microporous polymeric film, preferably biaxially stretched.

In another embodiment, the ink receiving layer containing the microporous polymeric film is coated with an additional ink receiving layer. The additional ink receiving layer may be another layer of microporous polymeric film. Preferably the layer is a comprised of a microparticle coating of inorganic pigment and binder. The inorganic pigment is selected from the group consisting of calcium carbonate, alumina, silica, and a combination of at least two of the above and the binder is selected from the group consisting of polyurethane, polyvinyl alcohol, and modified polyvinyl alcohol.

The heat transfer recording sheet of the present invention also comprises an adhesive layer. The adhesive layer is comprised of a material selected from the group consisting of silicon based, acrylic based, polyolefin copolymer, poly vinyl alcohol, and poly vinyl acetate pressure sensitive adhesives. The heat transfer recording sheet of the present invention also comprises a support layer. The support layer is comprised of a material selected from the group consisting of paper, cloth, nonwoven fabric and thermo heat-resistant plastic film.

The present invention also encompasses a method of heat transferring images onto a target substrate comprising, providing a heat transfer recording sheet wherein the recording sheet is comprised of a support layer; an adhesive; and at least one ink receiving layer comprising a microporous polymeric film which includes at least one thermoplastic polymer, wherein the microporous polymeric film is hydrophilic; printing an image on the recording sheet; positioning the recording sheet on a target substrate such that the printed image is in contact with the target substrate; applying heat and pressure to the surface of the recording sheet that is opposite to the surface containing the image; removing the support layer such that the image remains on the target substrate. The target substrate includes paper, plastic, textiles, wood, metal, glass, ceramics, leather, formica and plaster.

Other objects, features and advantages of the present invention will be apparent when the detailed description of the preferred embodiment of the invention are considered with reference to the drawings which should be construed in an illustrative and not limiting sense as follows:

BRIEF DESRIPTION OF THE DRAWINGS

DETAILED DESCRIPTION

The present invention is directed to a heat transfer recording sheet which allows the user to print using ink jet printing or other digital methods and to transfer a printed image onto textiles such as cloth and fabric, as well as wood, glass, ceramics etc.

Figure 1:
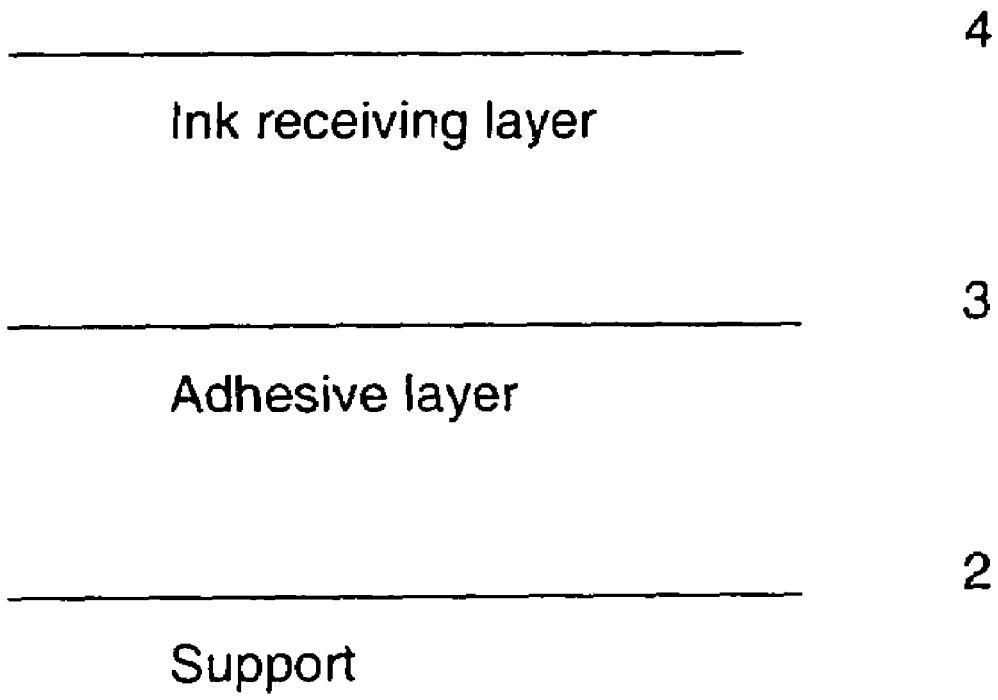
FIG. 1 is a schematic illustration of the heat transfer recording sheet according to the invention.

As illustrated in FIG. 1, the present invention provides a heat transfer recording sheet 10 comprising a support layer 2; an adhesive layer 3; and at least one ink receiving layer 4 comprised of a microporous polymeric film which includes at least one thermoplastic polymer. The microporous polymeric film is preferably made by extruding a thermoplastic polymer to form a film, allowing the film to cool and then stretching the film to the extent that such micropores of the desired size are formed in the film. Preferably, the film is stretched biaxially, i.e. in the X and Y directions. The film may also be annealed after it is stretched.

The size of the micropores is in the range of 10 nanometers to 350 nanometers.

Other methods for forming the microporous polymeric film include using a high energy electronic beam to mechanically ablate the film and generate micropores, using a laser to create micropores, or extruding the film and using a special solvent to dissolve and extract some of the film to create the micropores.

The ink receiving layer 4 for the purpose of receiving an image is comprised of a microporous polymeric film which includes at least one thermoplastic polymer; and the microporous polymeric film is hydrophilic. The ink receiving layer containing the microporous polymeric film functions in two ways. The first is to receive the ink and hold the pigment and/or dye in the ink on the surface of the recording sheet. The second is to provide adhesive properties when heated to transfer the recording sheet to the target substrate. Varying the thickness of the microporous polymeric film can vary ink absorption capacities. In a preferred embodiment, the microporous polymeric film is 10 μm to 100 μm, preferably 15 μm to 75 μm. The ink receiving layer containing the microporous polymeric film is applied using roll-to-roll lamination as is commonly used by those skilled in the art, such as in making label stock.

The thermoplastic polymer is selected from the group consisting of polyolefin, polyester, polyamide, and polyurethane. Preferably, the thermoplastic polymer is a polyolefin, and more preferably polyethylene and polypropylene.

The thermoplastic polymer can also be a polar functional monomer and a polyolefin copolymer. In this instance, the polyolefin can be polypropylene and the monomer is selected from the group consisting of acrylic acid, acrylate, methacrylic acid, methacrylate, maleic acid, maleic anhydride, vinyl acetate, vinyl alcohol, vinyl chloride, vinylidene chloride and sytrene. Alternatively, the polyolefin can be butadiene and the monomer can be styrene. In this embodiment, acrylonitrile can be optionally part of the copolymer. The choice of thermoplastic polymer may be dependent on the end use, i.e., the choice of target substrate. In some applications, you may want to use more than one thermoplastic polymer.

Since the inks used in ink jet and other forms of digital printing contain water as part of the ink solvent, in order for the ink to be absorbed by the recording sheet, the microporous polymeric film should be hydrophilic or water wettable. There are various methods for making the ink receiving layer containing the microporous polymeric film hydrophilic, including blending the thermoplastic polymer with a hydrophilic polymer melt additive, prior to extrusion and stretching. Another method is to coat the ink receiving layer containing the microporous polymeric film with a microparticle coating of inorganic pigment and binder. These methods are described in U.S. Published Application No. 2002/0009576A1 for ink jet printing in general, the disclosure of which is incorporated by reference. Other commercially available hydrophilic microporous polymeric films can be used such as Celgard 3501 (Celgard LLC, Charlotte, N.C.).

The method which utilizes a polymeric melt additive is preferable for transferring images to make T-shirts or other cloth garments. More specifically, the thermoplastic polymer, which is in the form of a powder, and a hydrophilic polymer melt additive are blended or mixed. The blend is heated to make a molten liquid, and the molten blend is extruded and stretched to form micropores. The resultant material is cooled to make the film which is solid. Preferably the blend is stretched biaxially, i.e. in the X and Y directions. The hydrophilic surface-active molecules of the blend migrate to the surface of the thermoplastic polymer, which is generally hydrophobic, thereby imparting hydrophilicity to the surface of ink receiving layer 4. The thickness of the blend is generally within the range of 10 μm to 100 μm.

The polymeric melt additive is comprised of a surfactant, sometimes also referred to by those of ordinary skill in the art as wetting agent. The surfactant can be any type suitable for polymer extrusion processing, effective as a wetting agent, and with the ability to migrate to the surface of the blend to impart the requisite hydrophilicity to the resulting film. Preferably, the surfactant is a fluorochemical surfactant. The addition of the hydrophilic polymeric melt additive to the thermoplastic polymer is accomplished at a range of concentration sufficient to form a compatible hydrophilic blend. Preferably, the amount of thermoplastic polymer in the blend is 92% to 99.9% by dry weight, most preferably 95% to 99.5%. Accordingly the amount of polymeric melt additive in the blend is from 0.1% to 8%, most preferably 0.5% and 5%.

Typically, the surfactant is in the form of a liquid. Depending on the design of the extruder, it may be necessary to solidify the surfactant in order to facilitate film extrusion. In these cases the surfactant is first melt-blended with a second thermoplastic resin to make the solid hydrophilic polymer melt additive (also known by those skilled in the art as polymer melt concentrate). The solid hydrophilic polymeric melt additive is then added as dry pellets to the first or base thermoplastic polymer resin pellets as feedstock in the film extrusion process. The extruded film of the blend is subsequently mechanically stretched to create the microporous polymeric film. In this instance, the amount of base thermoplastic resin in the blend is between 80% and 99.5% by dry weight, most preferably 90% to 98%. Accordingly, the amount of polymeric melt additive in the blend is preferably between 0.5% and 20% by dry weight, and most preferably 2% to 15%. The amount of surfactant in the polymeric melt additive is 20% to 40% by dry weight and most preferably 25% to 35%.

A suitable fluorochemical surfactant is available under the tradename FC-1296 (Minnesota Mining and Manufacturing Company, St. Paul, Minn.). FC-1296 is a compound or mixture of the following materials: 49% to 50% by dry weight of fluorochemical polymer, 49% to 50% by dry weight of hydrocarbon surfactant, and 0% to 1% by dry weight residual organic fluorochemicals. Since FC-1296 is available as a liquid, thermoplastic resins such as polybutylene and polypropylene are generally added to the FC-1296 to solidify it for blending, as described above.

To improve the lightfastness of the resulting image, anti-oxidants; anti-static agents such as alkyl quaternary ammonium, alkyl sulfonic salts; anti-blocking agents; UV absorbers such as Hindered Amine light stabilizers (HALS); UV stabilizers such as Tinuvin® (Ciba Specialty Chemicals, Tarrytown, N.Y.); thermal stabilizers such as tin-based, non-sulfur anions; oxygen stabilizers; and plasticizers such as phthalates can be incorporated into the blend. Incorporating one or more dye fixatives also improves the color density of the printed image. Often, these materials are already combined with the thermoplastic polymer and can be purchased in that manner.

Figure 2:
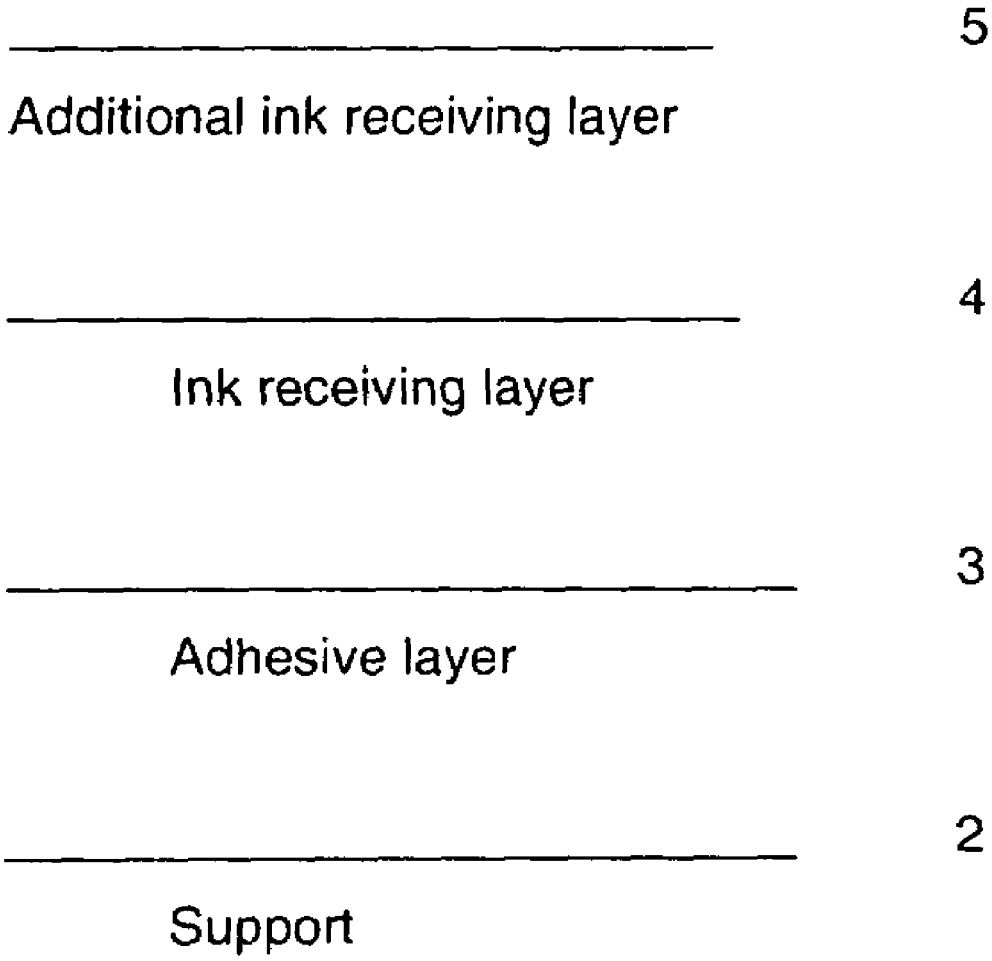
FIG. 2 is a schematic illustration of another embodiment of the heat transfer recording sheet according to the invention.

In another embodiment, illustrated by FIG. 2, a heat transfer recording sheet 20 is provided comprising at least one additional ink receiving layer of the same or different thickness as ink receiving layer 4, containing the blend of microporous polymeric film and hydrophilic polymeric melt additive can be coated onto ink receiving layer 4 to enhance ink absorption of the recording sheet. Ink receiving layer 5 can be made with the same or different thermoplastic polymer as what was used in ink receiving layer 4. While most of the ink printed resides in the uppermost ink receiving layer, some will most likely pass through to the lower layer(s), depending on the amount of ink applied during printing. This however will not affect the appearance of the printed image because the microporous polymeric film(s), which, depending on the thickness of the film(s) and size of the micropores, is opaque, translucent or semi-transparent prior to transfer, becomes transparent after heat and pressure are applied. The heat and pressure seal the micropores and makes the film transparent.

In this embodiment, all of the additional ink receiving layers comprise a blend of microporous polymeric film and hydrophilic polymeric melt additive.

In another embodiment, also illustrated in FIG. 2, the exposed surface of the ink receiving layer 4 containing the microporous polymeric film is coated with at least one additional ink receiving layer 5 comprised of a microparticle coating. The coating imparts the requisite hydrophilicity to the first ink receiving layer. Depending upon the amount of ink applied, the ink will either remain in the ink receiving layer containing the microparticle coating, or also be absorbed by the microporous polymeric film.

The surface of the film modified by the microparticle coating allows for efficient ink absorption because it makes the ink receiving layer containing the microporous polymeric film hydrophilic. In this embodiment, it is not necessary to blend the microporous polymeric film with hydrophilic polymeric melt additive because the additional ink receiving layers are imparting the requisite hydrophilicity to the microporous polymeric film. However, for certain high-end ink jet recording or other digital recording applications such as photographic prints, the microparticle coating layer containing inorganic pigment and binder can be applied on top of an ink receiving layer containing the microporous polymeric film which is comprised of the blend of thermoplastic polymer and hydrophilic polymeric melt additive. This provides even further hydrophilic properties to the recording sheet, thereby enhancing ink reception.

The microparticle coating comprises colloidal or submicron inorganic pigment particles and an organic polymer binder.

The inorganic pigment is selected from the group consisting of calcium carbonate, alumina, silica, and a combination of at least two of the above. Preferably, the pigment is alumina and/or silica. The inorganic pigment should be submicron particle size, i.e. below 0.4 microns (μm) and is preferably applied as a colloidal suspension in the form of an alumina sol or silica sol.

The binder is selected from the group consisting of polyurethane, polyvinyl alcohol, and modified polyvinyl alcohol. The binder may further comprise a cross-linking agent. However, the amount of cross-linking agent should be minimized since too much cross-linking agent will harden the microporous polymeric film, making application of the microporous polymeric film to the target substrate too difficult.

The amount of pigment in the microparticle coating is between 60% and 95% by dry weight, preferably 70% to 90%. Accordingly, the amount of binder is between 5% and 40% by dry weight, preferably, 10% to 30%. The thickness of this layer is 1 to 35 μm, and preferably 5 to 30 μm.

Surfactant, plasticizer, and/or defoamers may also be added to the microparticle coating.

The additional ink receiving layer(s) are applied to the exposed surface of the first ink receiving layer containing the microporous polymeric film, which has been adhered to a support such as paper. The additional ink receiving layer or layers can be applied by dipping, spraying, rod coating, blade coating, flexography, gravure printing or curtain coating. The layer is transparent.

The heat transfer recording sheets of the present invention further comprise an adhesive layer 2. The purpose of the adhesive layer is to hold the microporous polymeric film onto the target substrate until the point of heat transfer. The adhesive layer lies on the side of the ink receiving layer containing the microporous polymeric film that will not be printed, but is also partly embedded in the microporous polymeric film.

The adhesives which make up the adhesive layer include pressure sensitive adhesives (PSA's) suitable for polypropylene, polyester and other common polymer film materials which are well-know to those skilled in the art. These include but are not limited to silicon-based, acrylic based and polyolefin copolymer PSAs, such as ethylene vinyl acetate and ethylene acrylate. Polyvinyl alcohol, and polyvinyl acetate PSAs are also suitable. For example, Airvol 523, (Air Products, Allentown, Pa.) is a suitable polyvinyl alcohol PSA for the present invention.

The thickness of the adhesive layer is in between 0.5 and 50 μm, preferably 2 μm to 10 μm. The adhesive layer can be applied by spraying, rod coating, blade coating, flexography, gravure printing or curtain coating.

The heat transfer recording sheets of the present invention further comprise a support layer. The support layer is comprised of a material selected from the group consisting of paper, cloth, nonwoven fabric, and thermo heat-resistant plastic film. The thermo heat-resistant plastic film should have a melting point higher than the temperature of the heat applicator e.g. iron, hot plate.

In one embodiment, alternatively, the heat transfer recording sheet can further comprise a release layer between the support layer and adhesive layer. The release layer is comprised of a materials commonly used by those skilled in the art to provide release properties to recording sheets, e.g. silicon-based release liners. Organic wax and latex-based release coatings may also be appropriate. The release layer is applied to the support layer and subsequently dried and cured to achieve release properties. The thickness of the release layer is 1 μm to 5 μm. Alternatively and more preferably, supports can be purchased with a release coating already applied to one side of the support and then the adhesive layer is applied to the release side of the support layer. For example, Silox paper ((Release Products (formerly Akrisol), International Paper, Menasha, Wis.)) is a silicon-coated paper support to provide release capability.

The present invention also encompasses a method of heat transferring images onto a target substrate. The method comprises providing a heat transfer recording sheet wherein the recording sheet is comprised of a support layer, an adhesive layer; and an ink receiving layer comprising a microporous polymeric film, including at least one thermoplastic polymer, wherein the microporous polymeric film is hydrophilic; printing an image on the recording sheet; positioning the recording sheet on a target substrate such that the printed image is in contact with the target substrate; applying heat and pressure to the surface of the recording sheet that is opposite to the surface containing the image; removing the support layer such that the image remains on the target substrate. When the image is transferred, all of the layers on top of the substrate, except the release layer or coating, will be transferred onto the target substrate, e.g. a T-shirt. The target substrate includes paper, plastic, textiles such as cloth, clothing and fabric, wood, metal, glass, ceramics, leather, formic and plaster. A reverse image should be printed on the heat transfer recording sheet.

The following Examples serve to illustrate the invention but is not meant to be limiting in any sense:

EXAMPLE I

A heat transfer recording sheet according to the present invention was prepared as follows:

Onto the release side of a sheet of 42-pound Silox release paper ((silicon-coated paper support to provide release capability (Release Products (formerly Akrisol), International Paper, Menasha, Wis.)) was coated an aqueous solution of 10% by weight of polyvinyl alcohol (Airvol 523, Air Products, Allentown, Pa.) using a #6 groove rod to form a thin wet adhesive layer.

While the adhesive layer was still wet, a hydrophilic microporous polymeric film comprised of treated polypropylene, commercially available as Celgard 3501 (Celgard LLC, Charlotte, N.C.), was attached smoothly and uniformly to the adhesive layer. The thickness of the microporous polymeric film was 25 μm. The resulting heat transfer recording sheet was dried in an oven at 35° C. for about 10 minutes until the adhesive layer was completely dried.

The prepared sheet was fed through an Epson Stylus Color 900 ink jet printer and a reverse image was printed onto the microporous polymeric film of the transfer recording sheet. The image dried quickly with no observable smearing.

The printed ink-jet image was pressed onto a white, cotton based, cloth fabric using an iron, on the cotton setting. The iron was applied firmly and evenly to the backside (non-coated side) of the recording sheet; the heat and pressure was applied evenly around the cloth for about 10 seconds.

Immediately thereafter while the recording sheet was still hot, the support layer of the recording sheet was peeled off by hand, leaving behind the microporous polymeric film containing the printed ink-jet image which was imprinted on the cloth fabric.

EXAMPLE II

A heat transfer recording sheet according to the present invention was prepared as follows:

Onto the release side of a sheet of 42-pound Silox release paper ((silicon-coated paper support to provide release capability (Release Products (formerly Akrisol), International Paper, Menasha, Wis.)) was coated an aqueous solution of 10% by weight of polyvinyl alcohol (Airvol 523, Air Products, Allentown, Pa.) using a #6 groove rod to form a thin wet adhesive layer.

While the adhesive layer was still wet a hydrophilic microporous polymeric film comprised of a blend of polypropylene and a polymeric melt additive. The polymeric melt additive is commercially available as FC-1296 (Minnesota Mining and Manufacturing Company, St. Paul, Minn.). The film was attached smoothly and uniformly to the adhesive layer. The thickness of the microporous polymeric film was 75 μm. The resulting heat transfer recording sheet was dried in an oven at 35° C. for 5 to 15 minutes until the adhesive layer was completely dried.

The prepared sheet was fed through an Epson Stylus Color 900 ink jet printer and a reverse image was printed onto the microporous polymeric film of the transfer recording sheet. The image dried quickly with no observable smearing.

The printed ink-jet image was pressed onto a white, cotton based, cloth fabric using an iron, on the cotton setting. The iron was applied firmly and evenly to the backside (non-coated side) of the recording sheet; the heat and pressure was applied evenly around the cloth for 5 to 10 seconds.

While the recording sheet was still warm, the support layer of the recording sheet was peeled off by hand, leaving behind the microporous polymeric film containing the printed ink-jet image which was imprinted on the cloth fabric. The image dried quickly with no observable smearing.

Finally, variations from the examples given herein are possible in view of the above disclosure. Therefore, although the invention has been described with reference to certain preferred embodiments, it will be appreciated that other microporous polymeric films and ink receiving materials may be devised and used to make heat transfer sheets which are nevertheless within the scope and spirit of the invention as defined in the claims appended hereto.

The foregoing description of various and preferred embodiments of the present invention has been provided for purposes of illustration only, and it is understood that numerous modifications, variations and alterations may be made without departing from the scope and spirit of the invention as set for the in the following claims.

The invention claimed is:

1. A heat transfer recording sheet, comprising a support layer;

an adhesive layer;

a release layer between the support layer and the adhesive layer; and at least one ink receiving layer comprising a microporous polymeric film, wherein the microporous polymeric film is hydrophilic and comprises at least one thermoplastic polymer.

2. The heat transfer recording sheet according to claim 1, wherein said release layer comprises wax, silicon, or mixtures thereof.

3. The heat transfer recording sheet according to claim 1, wherein the thickness of said microporous polymeric film is from 10 to 100 μm.

4. The heat transfer recording sheet according to claim 1, wherein said thermoplastic polymer is at least one member selected from the group consisting of polyolefin, polyester, polyamide, and polyurethane.

5. The heat transfer recording sheet according to claim 4, wherein said polyolefin is at least one member selected from the group consisting of polyethylene and polypropylene.

6. The heat transfer recording sheet according to claim 1, wherein said thermoplastic polymer comprises at least one polyolefin and at least one polar functional monomer copolymer.

7. The heat transfer recording sheet according to claim 6, wherein the at least one polyolefin is polypropylene.

8. The heat transfer recording sheet according to claim 6, wherein said at least one polar functional monomer is selected from the group consisting of acrylic acid, acrylate, methacrylic acid, methacrylate, maleic acid, maleic anhydride, vinyl acetate, vinyl alcohol, vinyl chloride, vinylidene chloride and styrene.

9. The heat transfer recording sheet according to claim 1, wherein said microporous polymeric film further comprises a hydrophilic polymer melt additive.

10. The heat transfer recording sheet according to claim 9, wherein said polymeric melt additive comprises a surfactant.

11. The heat transfer recording sheet according to claim 9, wherein the thermoplastic polymer is present at an amount that is from 80 to 99.9% by dry weight and the polymeric melt additive is present in an amount that is from 0.1% to 20% by dry weight, based upon the total weight of the film.

12. The heat transfer recording sheet according to claim 1, wherein said ink receiving layer is coated with at least one additional ink receiving layer.

13. The heat transfer recording sheet according to claim 12, wherein said at least one additional ink receiving layer comprises a microporous polymeric film.

14. The heat transfer recording sheet according to claim 12, wherein said additional ink receiving layer comprises at least one member selected from the group consisting of an inorganic pigment and binder.

15. The heat transfer recording sheet according to claim 14, wherein said inorganic pigment is at least one member selected from the group consisting of calcium carbonate, alumina, and silica.

16. The heat transfer recording sheet according to claim 14, wherein said binder is at least one member selected from the group consisting of polyurethane, polyvinyl alcohol, and modified polyvinyl alcohol.

17. The heat transfer recording sheet according to claim 1, wherein said adhesive layer comprises at least one pressure sensitive adhesive.

18. The heat transfer recording sheet according to claim 1, wherein said adhesive layer comprises at least one member selected from the group consisting of silicon based pressure sensitive adhesive, acrylic based pressure sensitive adhesive, polyolefin copolymer, polyvinyl alcohol, ethylene vinyl acetate, ethylene acrylate, and polyvinyl acetate.

19. The heat transfer recording sheet according to claim 1, wherein said support layer comprises at least one member selected from the group consisting of paper, cloth, non-woven fabric and thermo heat-resistant plastic film.

20. The heat transfer recording sheet according to claim 1, wherein said microporous polymeric film is ink jet printable.

21. The heat transfer recording sheet according to claim 1, wherein the thickness of said microporous polymeric film is from 0.5 to 50 μm.

* * * * *